US009334695B2

(12) United States Patent
Hatton

(10) Patent No.: US 9,334,695 B2
(45) Date of Patent: May 10, 2016

(54) HYBRID RISER SYSTEM

(71) Applicant: Magma Global Limited, Portsmouth (GB)

(72) Inventor: Stephen Hatton, Surrey (GB)

(73) Assignee: Magma Global Limited, Portsmouth (GB)

( * ) Notice: Subject to any disclaimer, the term of this patent is extended or adjusted under 35 U.S.C. 154(b) by 0 days.

(21) Appl. No.: 14/057,289

(22) Filed: Oct. 18, 2013

(65) Prior Publication Data

US 2014/0041878 A1 Feb. 13, 2014

Related U.S. Application Data

(63) Continuation of application No. PCT/GB2012/000354, filed on Apr. 18, 2012, which is a continuation-in-part of application No. 13/158,100, filed on Jun. 10, 2011, now abandoned.

(30) Foreign Application Priority Data

| | | |
|---|---|---|
| Apr. 18, 2011 | (GB) | 1106473.0 |
| Jul. 20, 2011 | (GB) | 1112469.0 |
| Sep. 20, 2011 | (GB) | 1116226.0 |

(51) Int. Cl.
*E21B 17/01* (2006.01)
*E21B 17/08* (2006.01)

(52) U.S. Cl.
CPC ..... *E21B 17/012* (2013.01); *E21B 17/085* (2013.01)

(58) Field of Classification Search
CPC ..... E21B 17/012; E21B 17/085; F16L 11/08
USPC ..... 166/350, 367; 138/132, 174; 405/171, 405/172, 184.5, 224.3
See application file for complete search history.

(56) References Cited

U.S. PATENT DOCUMENTS

| | | | |
|---|---|---|---|
| 3,688,840 | A | 9/1972 | Curington et al. |
| 3,768,842 | A | 10/1973 | Ahlstone |

(Continued)

FOREIGN PATENT DOCUMENTS

| | | |
|---|---|---|
| EP | 0244048 A2 | 1/1987 |
| FR | 2852677 | 9/2004 |

(Continued)

OTHER PUBLICATIONS

International Search Report and Written Opinion in corresponding PCT Application No. PCT/GB2012/000354 dated Aug. 2, 2013.

(Continued)

*Primary Examiner* — Matthew Buck
(74) *Attorney, Agent, or Firm* — Blank Rome, LLP

(57) ABSTRACT

A hybrid riser system comprises a lower riser section secured between a lower subsea anchor and an upper buoyant structure, and an upper riser section extending between the lower riser section and a surface or near surface vessel. The lower riser section comprises an elongate support and one or more composite fluid conduits secured to and extending adjacent the elongate support. The composite fluid conduits comprise a composite material formed of at least a matrix and one or more reinforcing elements embedded within the matrix. The upper riser section comprises one or more flexible conduits in fluid communication with the composite fluid conduits.

36 Claims, 4 Drawing Sheets

(56) References Cited

U.S. PATENT DOCUMENTS

| | | | | | |
|---|---|---|---|---|---|
| 4,097,069 | A | | 6/1978 | Morrill | |
| 4,098,333 | A | * | 7/1978 | Wells et al. | 166/352 |
| 4,116,009 | A | | 9/1978 | Daubin | |
| 4,194,568 | A | * | 3/1980 | Buresi et al. | 166/340 |
| 4,228,857 | A | * | 10/1980 | Nobileau | 166/341 |
| 4,332,509 | A | * | 6/1982 | Reynard et al. | 405/168.1 |
| 4,462,717 | A | * | 7/1984 | Falcimaigne | 405/224.3 |
| 4,470,722 | A | * | 9/1984 | Gregory | 405/224.2 |
| 4,487,434 | A | | 12/1984 | Roche | |
| 4,550,936 | A | | 11/1985 | Haeber et al. | |
| 4,634,314 | A | * | 1/1987 | Pierce | 405/224.2 |
| 4,662,785 | A | * | 5/1987 | Gibb et al. | 405/195.1 |
| 4,673,313 | A | * | 6/1987 | Baugh et al. | 405/224.3 |
| 4,728,224 | A | * | 3/1988 | Salama et al. | 405/224.2 |
| 5,330,294 | A | | 7/1994 | Guesnon | |
| 5,474,132 | A | * | 12/1995 | Gallagher | 166/367 |
| 5,634,671 | A | | 6/1997 | Watkins | |
| 5,657,823 | A | * | 8/1997 | Kogure et al. | 166/340 |
| 5,660,233 | A | | 8/1997 | Sparks | |
| 6,082,391 | A | * | 7/2000 | Thiebaud et al. | 137/236.1 |
| 6,321,844 | B1 | * | 11/2001 | Thiebaud et al. | 166/345 |
| 6,415,867 | B1 | | 7/2002 | Deul et al. | |
| 6,419,277 | B1 | | 7/2002 | Reynolds | |
| 6,538,198 | B1 | | 3/2003 | Wooters | |
| 6,612,370 | B1 | * | 9/2003 | Jahnsen et al. | 166/367 |
| 6,615,922 | B2 | | 9/2003 | Deul et al. | |
| 6,837,311 | B1 | * | 1/2005 | Sele et al. | 166/353 |
| 7,100,694 | B2 | * | 9/2006 | Legras et al. | 166/350 |
| 7,104,330 | B2 | * | 9/2006 | Legras et al. | 166/367 |
| 7,367,398 | B2 | * | 5/2008 | Chiesa et al. | 166/302 |
| 7,398,697 | B2 | | 7/2008 | Allen et al. | |
| 7,434,624 | B2 | * | 10/2008 | Wilson | 166/368 |
| 7,441,602 | B2 | * | 10/2008 | Saint-Marcoux | 166/302 |
| 7,762,337 | B2 | | 7/2010 | Papon et al. | |
| 8,037,939 | B2 | | 10/2011 | Poirette et al. | |
| 8,322,438 | B2 | | 12/2012 | Larson et al. | |
| 8,387,707 | B2 | | 3/2013 | Adamek et al. | |
| 8,430,170 | B2 | * | 4/2013 | Pionetti | 166/350 |
| 8,474,540 | B2 | | 7/2013 | Guesnon et al. | |
| 8,733,446 | B2 | * | 5/2014 | Espinasse et al. | 166/350 |
| 8,734,055 | B2 | * | 5/2014 | Remery et al. | 405/171 |
| 2002/0168232 | A1 | * | 11/2002 | Xu et al. | 405/224 |
| 2005/0063788 | A1 | * | 3/2005 | Clausen | 405/224.2 |
| 2005/0158126 | A1 | * | 7/2005 | Luppi | 405/224.2 |
| 2007/0048093 | A1 | | 3/2007 | Bhat et al. | |
| 2010/0018717 | A1 | * | 1/2010 | Espinasse et al. | 166/346 |
| 2010/0172699 | A1 | * | 7/2010 | Saint-Marcoux | 405/224.2 |
| 2010/0300699 | A1 | | 12/2010 | Papon et al. | |
| 2011/0017466 | A1 | | 1/2011 | Averbuch et al. | |
| 2011/0073315 | A1 | | 3/2011 | Guesnon et al. | |
| 2012/0037377 | A1 | | 2/2012 | Walker | |
| 2012/0160510 | A1 | | 6/2012 | Bhat et al. | |
| 2012/0292040 | A1 | * | 11/2012 | Prescott | 166/345 |

FOREIGN PATENT DOCUMENTS

| | | | |
|---|---|---|---|
| GB | 2370852 | A | 8/1999 |
| GB | 2400622 | A | 10/2004 |
| WO | 99/57413 | | 11/1999 |
| WO | 99/57413 | A1 | 11/1999 |
| WO | 00/08262 | A1 | 2/2000 |
| WO | 00/66927 | A1 | 11/2000 |
| WO | 00/70256 | A | 11/2000 |
| WO | 02/072995 | | 9/2002 |
| WO | 02/072995 | A1 | 9/2002 |
| WO | 03/102357 | A1 | 12/2003 |
| WO | 2007/083238 | A2 | 7/2007 |
| WO | 2010/030160 | A1 | 3/2010 |
| WO | 2011/028432 | A2 | 3/2011 |
| WO | 2011/050064 | A | 4/2011 |

OTHER PUBLICATIONS

Search Report from priority UK Appl. GB1106473.0, dated May 16, 2011.

Search Report from priority UK Appl. GB1112469.0, dated Oct. 17, 2011.

Search Report from priority UK Appl. GB1116226.0, dated Nov. 16, 2011.

Int'l. Search Report in PCT Appl. PCT/GB2012/000355 counterpart to priority UK Appl. GB1106473.0, mailed Aug. 12, 2013.

Partial Int'l Search Report in PCT Appl. PCT/GB2012/051317 counterpart to priority UK Appl. GB1112469.0, mailed Oct. 15, 2013.

First Office Action in copending U.S. Appl. No. 13/158,100, mailed Jul. 17, 2013.

First Office Action in copending U.S. Appl. No. 14/057,310, mailed May 21, 2014.

Second Office Action in copending U.S. Appl. No. 14/057,310, mailed Dec. 5, 2014.

Third Office Action in copending U.S. Appl. No. 14/057,310, mailed Jun. 4, 2015.

* cited by examiner

HYBRID RISER SYSTEM

FIELD OF THE INVENTION

The present invention relates to a hybrid riser system.

BACKGROUND OF THE INVENTION

In the offshore oil and gas industry fluid communication between a subsea location and a surface vessel, such as a FPSO vessel, is achieved via conduit systems called risers. Many riser configurations exist, such as catenary risers, top tensioned risers and hybrid risers.

A hybrid riser typically consists of a near vertical bundle of metallic pipes composed of a plurality of outer conduits circumferentially arranged around a larger diameter central structural pipe that is typically evacuated and sealed. The outer pipes are often referred to as peripheral lines and are used for fluid communication along the length of the riser bundle. The lower end of the bundle is anchored, via the central structural pipe, at the seabed and terminated near the water surface by a large buoyant structure, such as an aircan which provides tension and thus supports the bundle of pipes in a manner to resist the applied environmental loads. At the top end of the riser bundle each peripheral line is connected to a surface vessel by a flexible pipe jumper configured in free hanging catenary geometry.

An advantage of the hybrid riser bundle over other riser configurations is that the bundle section is largely static and unaffected by wave and vessel motions due to the location of the top section below the wave zone and the use of flexible jumpers that largely isolate vessel motions from the bundle section.

A further benefit of the hybrid bundle is that it can be designed to be neutrally buoyant, beach fabricated and installed using a tow out and upending installation method. Neutral buoyancy is achieved through the application of syntactic foam modules along the entire riser length to support the steel peripheral lines. Such use of syntactic buoyancy modules is illustrated in FIG. 1 which is a lateral cross section of a portion of a known hybrid bundle 10. The bundle 10 includes a large diameter central structural pipe 12 which is surrounded by smaller diameter peripheral lines 14. Syntactic foam segments or modules 16 are provided to completely encase the pipe 12 and lines 14.

Following installation the riser can free stand by virtue of its syntactic buoyancy and supporting aircan following which the flexible jumpers can be installed and connected between the hybrid bundle and surface vessel.

As noted above, known hybrid riser systems incorporate syntactic buoyancy material, such as is illustrated in FIG. 1. In addition to providing buoyancy such material is also considered to insulate the peripheral lines. Although a degree of insulating may be achieved, this can be insufficient due to hot water convection losses in the water gap 18 (FIG. 1) between the lines 14 and the buoyancy material 16 and as such specialised insulation materials are often needed in addition to the syntactic buoyancy. Furthermore, the syntactic buoyancy material is very expensive with few international suppliers.

A further disadvantage is that the weight of the peripheral lines is such that the upper aircan becomes excessively large, particularly in deep water, such that it is difficult to fabricate, launch and handle during installation.

Another disadvantage of known hybrid riser systems is the problem associated with the structural interaction between the peripheral lines and the central structural member. Typically the peripheral lines are suspended from the top end of the bundle and allowed to hang down and slide axially with respect to the central structural pipe. As such the peripheral lines will normally have a maximum tension at their top end due to self weight and zero tension at their lower end. At the top end of each peripheral line their weight is reacted into the central pipe and whilst the effective tension across the section may be modest the true wall tension in the wall of the central structural pipe may be prohibitive such that this may limit the weight and number of peripheral lines which are feasible. This has a serious impact on the applicable water depth.

The problem of peripheral line axial movement with respect to the central pipe is further compounded when the bundle section is flexed and the resultant changes in curvature cause further relative axial motion between the central pipe and peripheral lines. Due to the high axial stiffness of the peripheral lines it is not practical to constrain this axial movement due to the resulting high tension and compression generated that can damage buoyancy modules and other fittings.

A further problem resulting from this known method of supporting the peripheral lines is that of relative expansion with respect to the central pipe. The peripheral lines expand and contract due to pressure and temperature effects such that the bottom end of the peripheral lines moves axially with respect to the central pipe. In deep water this may be a significant movement in the order of 1-5 m and it is recognised by those skilled in the art that this is a difficult problem to resolve requiring large and complex jumper pipes with sufficient flexibility to accommodate the movement.

These and other design issues increase in complexity with depth and the number of peripheral lines such that it is difficult to economically use this technology beyond certain water depths.

U.S. Pat. No. 6,082,391 describes an example of a known hybrid riser system.

SUMMARY OF THE INVENTION

According to a first aspect of the present invention there is provided a hybrid riser system, comprising:

a lower riser section secured between a lower subsea anchor and an upper buoyant structure and comprising an elongate support and a plurality of composite fluid conduits secured to and extending adjacent the elongate support, wherein the composite fluid conduits comprise a composite material formed of at least a matrix and one or more reinforcing elements embedded within the matrix; and an upper riser section extending between the lower riser section and a surface or near surface vessel and comprising a plurality of flexible conduits in fluid communication with the composite fluid conduits.

In use, fluid communication may be achieved between a subsea location and the surface or near surface vessel via the composite fluid conduits of the lower riser section and the flexible conduits of the upper riser section.

The hybrid riser system may be configured to accommodate fluid communication from a subsea location to a surface or near surface vessel. In one particular embodiment the hybrid riser system may be configured to accommodate fluid communication of hydrocarbon product from a subsea production field to a surface or near surface vessel, such as a FPSO vessel. The hybrid riser system may be configured to accommodate fluid communication from a surface or near surface vessel to a subsea location. For example, the riser system may accommodate fluid communication of, for example, hydraulic fluid for actuation of a tool, injection fluids for injection into a subterranean wellbore, purging fluid and the like.

The composite construction of the fluid conduits may allow the cross section of the lower riser section to be greatly simplified and at the same time provide improved performance. For example, the composite construction may permit the composite fluid conduits to be configured with near neutral buoyancy when the lines are air filled in-water. This may allow the need for complex and expensive additional buoyancy, such as syntactic buoyancy material, to be eliminated or at least minimised. In some embodiments, the hybrid riser system may not include any specialised buoyancy measures, such as syntactic buoyancy material.

The composite construction of the fluid conduits may permit said conduits to exhibit sufficiently high strength to accommodate pressure loading and other applied loadings. Furthermore, the composite construction may permit the fluid conduits to be significantly lighter than non-composite pipe, such as metallic pipe or non-bonded pipe. Such light weight may lead to numerous advantages, some of which will be described below.

The composite construction of the fluid conduits may permit significantly improved thermal characteristics in comparison to non-composite pipe structures. For example, the composite construction may provide greatly reduced thermal conductivity which reduces heat loses and allows the need for insulation to be eliminated or greatly reduced. Furthermore, the composite construction may assist to minimise thermal expansion characteristics. For example, the composite construction of the fluid conduits may permit lower axial length variation compared to non-composite structures and thus assist to eliminate or at least alleviate associated problems. However, even in circumstances where axial length variation does occur, such variations can be accommodated by the composite construction by virtue of an increased ability to accommodate higher strain rates. Thus, for example, axial compression and tensile forces may be more readily accommodated. Furthermore, any lateral deformations caused by axial extension may also be readily accommodated without risk of exceeding operational yield limits.

The lower riser section may be arranged in a substantially linear configuration. That is, in an unloaded state the lower riser section may be substantially straight. The lower riser section may be arranged in a substantially vertical orientation. Such a vertical orientation may be achieved by action of the buoyant structure providing upward thrust. This upward thrust may provide a degree of tension within the lower riser section. The provision of fluid conduits comprising or formed by a composite material greatly reduces the weight of these conduits relative to non-composite structures. This arrangement may permit a reduction in the required upward thrust provided by the buoyant structure. Accordingly, the required volume of the buoyant structure may be significantly reduced relative to prior art systems. In some embodiments the present invention may permit a reduction in volume of the buoyant structure of up to 50% relative to prior art systems.

The buoyant structure may be entirely submerged. This arrangement may permit the buoyant structure, and thus the lower riser section to be isolated from surface conditions, such as wave conditions and the like.

The buoyant structure may comprise an aircan. The buoyancy structure may comprise buoyant material, such as foam or the like.

The elongate support may be secured between the lower anchor and the upper buoyant structure. Accordingly, upward thrust applied by the buoyant structure may establish tension within the elongate support.

The elongate support may define a rigid structure.

The elongate support may comprise a pipe or string of pipes. In such an arrangement the elongate support may be arranged to be sealed such that said support may exhibit a degree of buoyancy relative to an equivalent non-sealed structure. The elongate support may comprise a space frame arrangement.

The elongate support may comprise a metal or metal alloy. The elongate support may comprise or be formed by a composite material.

The lower subsea anchor may define a seabed anchor. The lower subsea anchor may be provided by any suitable anchor as might be selected by a person of skill in the art, such as a gravity base, suction pile, drilled and grouted pile, driven pile, jetted pile and the like.

The lower subsea anchor may comprise a subsea wellhead. The lower subsea anchor may comprise subsea production infrastructure, such as a manifold assembly or the like.

A composite fluid conduit may be secured to the elongate support at at least one location. A composite fluid conduit may be rigidly secured to the elongate support at at least one location. Such a rigid connection may permit load transference between the conduit and the elongate support. The elongate support may be configured to support the weight of one or more of the composite fluid conduits. By virtue of the composite construction of the fluid conduits, weight may be minimised such that the load transferred to the elongate support may also be minimised. This may permit the hybrid riser system to be utilised in greater water depths. Furthermore, a degree of downsizing of the elongate support may be possible.

A composite fluid conduit may be rigidly secured to an upper region of the elongate support.

A composite fluid conduit may be rigidly secured to a lower region of the elongate support.

A composite fluid conduit may be rigidly secured to both upper and lower regions of the elongate support. In such an arrangement any changes in axial length of the fluid conduit, for example by thermal and pressure effects, may result in axial compressive and/or tensile forces, and/or forces resulting from lateral deformation. Furthermore, any longitudinal bending of the elongate support, for example due to environmental conditions, may result in axially applied forces. For example, a fluid conduit on an inner side of a bend radius of the elongate structure will be subject to compressive forces, and perhaps also forces caused by any resulting lateral deformation. Conversely, a fluid conduit on an outer side of a bend radius of the elongate support will be subject to tensile forces. However, the composite construction of the fluid conduits may permit increased strain rates to be accommodated thus permitting such deformations and associated loading to be readily accommodated within yield limits.

A composite fluid conduit may be rigidly secured to an intermediate region of the elongate support.

A composite fluid conduit may be compliantly secured to the elongate support at at least one location. In such an arrangement a compliant connection may be achieved in at least one direction or plane, for example in at least one of an axial and lateral direction. Such a compliant connection arrangement may, for example, permit the composite fluid conduit to be retained in close proximity to the elongate support structure, without requiring a rigid connection. As such, at the locations of compliant connection a degree of relative movement of the fluid conduit and the elongate support may be permitted. Such relative movement may comprise axial movement. In such a complaint connection arrangement relative lateral movement between the fluid conduit and the elongate structure at the point of connection may be substantially prevented.

A composite fluid conduit may be compliantly secured to the elongate support at a location which is intermediate opposing end regions of the elongate support.

A composite fluid conduit may be compliantly secured to the elongate support at multiple locations.

The riser system may comprise at least one guide structure configured to retain or guide one or more of the fluid conduits in close proximity to the elongate support. The guide structure may be configured to provide a compliant connection, at least in one plane or direction, between a fluid conduit and the elongate support. The guide structure may comprise one or more tubular guide portions configured to accommodate passage of one or more fluid conduits therethrough. The guide structure may form an integral part of the elongate support. The guide structure may be formed separately of the elongate support and configured to be secured thereto.

One or more of the fluid conduits may extend externally of the elongate support. One or more of the fluid conduits may extend internally of the elongate support.

A composite fluid conduit may be non-metallic. That is, the wall structure of a composite fluid conduit does not include any metallic material.

One or more composite fluid conduits may be formed exclusively from the composite material. For example, the entire wall thickness of the composite fluid conduits may be formed of the composite material. In some embodiments the quantity of reinforcing elements may vary through the wall thickness of the composite fluid conduits. In one embodiment the quantity of reinforcing elements may vary from zero at the inner region of the wall of a composite fluid conduit, and increase in quantity in an outwardly radial direction. In such an arrangement the inner region of the wall of a composite fluid conduit may be composed substantially entirely of matrix material.

The present invention may exclude non-bonded pipe structures.

A flexible conduit may extend between the vessel and the lower riser section in a catenary form.

The flexible conduits may independently extend between the vessel and the lower riser section. The flexible conduits, or at least some of the flexible conduits may be secured together, for example bundled together, to extend collectively between the lower riser section and the vessel.

One or more flexible conduits may be integrally formed with one or more corresponding composite fluid conduits. For example, a flexible conduit may be defined by a continuation of a composite fluid conduit.

One or more flexible conduits may be separately formed and coupled to corresponding composite fluid conduits, for example via a sealed connection.

One or more of the flexible conduits may comprise a composite material formed of at least a matrix and one or more reinforcing elements embedded within the matrix. The composite material of the flexible conduits may be identical, similar or different from the composite material of the fluid conduits.

In embodiments where flexible conduits comprise or are formed by a composite material the weight of said flexible conduits will be lower than, for example, non-composite pipe, such as metallic pipe, non-bonded pipe or the like. As such, the dynamic response of the flexible conduits may be unfavourable, for example responses to environmental conditions, deviations of the vessel, vortex induced vibrations and the like. To seek to address such an issue the hybrid riser system may comprise a weight arrangement secured to one or more flexible conduits of the upper riser section. The weight arrangement may be configured to modify the dynamic response of one or more flexible conduits of the upper riser section. The weight arrangement may be configured to bias a flexible conduit into a desired shape or form, such as a catenary form. The weight arrangement may be secured to a region of one or more flexible conduits which is intended to define a lowermost region of said one or more flexible conduits. A single weight arrangement may be provided. In such an arrangement the single weight arrangement may be secured to one or a plurality of flexible conduits. A plurality of weight arrangements may be provided and secured to different flexible conduits or different groups of flexible conduit.

The weight arrangement may be configured to apply tension within a flexible conduit between the vessel and the point of connection of the weight arrangement to the flexible conduit. The weight arrangement may be configured to apply tension within a flexible conduit between the lower riser section and the point of connection of the weight arrangement to the flexible conduit.

The weight arrangement may comprise one or more chain links. Such chain link weight has a number of advantages. For example, an appropriate number of links can be selected to provide a chain with a desired weight, and the length of the chain can be readily extended or shortened. Further, a chain is compliant if it impacts another object and is considered to be relatively easily handled using standard offshore practices and standards.

The matrix of the composite material of a fluid conduit may comprise a polymer material. The matrix may comprise a thermoplastic material. The matrix may comprise a thermoset material. The matrix may comprise a polyaryl ether ketone, a polyaryl ketone, a polyether ketone (PEK), a polyether ether ketone (PEEK), a polycarbonate or the like, or any suitable combination thereof. The matrix may comprise a polymeric resin, such as an epoxy resin or the like.

The reinforcing elements of the composite material of a fluid conduit may comprise continuous or elongate elements. The reinforcing elements may comprise any one or combination of polymeric fibres, for example aramid fibres, or non-polymeric fibres, for example carbon, glass or basalt elements or the like. The reinforcing elements may comprise fibres, strands, filaments, nanotubes or the like. The reinforcing elements may comprise discontinuous elements.

The matrix and the reinforcing elements of the composite material of a fluid conduit may comprise similar or identical materials. For example, the reinforcing elements may comprise the same material as the matrix, albeit in a fibrous, drawn, elongate form or the like.

The composite material of a wall of a composite fluid conduit may comprise or define a local variation in construction to provide a local variation in a property of the fluid conduit.

Such a local variation in a property of the fluid conduit may permit tailoring of a response of the fluid conduit to given load conditions.

The local variation in construction may comprise at least one of a circumferential variation, a radial variation and an axial variation in the composite material and/or the fluid conduit geometry.

In some embodiments at least one location of a fluid conduit which is configured to interact with another structure, such as a region of rigid connection, compliant connection or the like, may define a local region of increased strength, for example by modified strength properties of the composite material components, by modified geometry, such as thicker material regions, or the like.

The local variation in construction may comprise a local variation in the composite material.

Each coil of wire may be axially distributed along the body portion of the deployable tool.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of a fluid conduit. For example, an element provided at a 0 degree alignment angle will run entirely longitudinally of the fluid conduit, and an element provided at a 90 degree alignment angle will run entirely circumferentially of the fluid conduit, with elements at intermediate alignment angles running both circumferentially and longitudinally of the fluid conduit, for example in a spiral or helical pattern.

The local variation in the alignment angle may include elements having an alignment angle of between, for example, 0 and 90 degrees, between 0 and 45 degrees or between 0 and 20 degrees.

At least one portion of a fluid conduit wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the fluid conduit, and which pre-stress is at least partially or residually retained within the manufactured fluid conduit. A local variation in reinforcing element pre-stress may permit a desired characteristic of a fluid conduit to be achieved, such as a desired bending characteristic. This may assist to position or manipulate the fluid conduit, for example during installation, retrieval, coiling or the like. Further, this local variation in reinforcing element pre-stress may assist to shift a neutral position of strain within a fluid conduit wall, which may assist to provide more level strain distribution when the fluid conduit is in use, and/or for example is stored, such as in a coiled configuration.

A fluid conduit may comprise a variation in construction of composite material along its length to provide a variation in axial strength. For example, an upper region of a fluid conduit which is typically exposed to greater tensile forces, for example due to self-weight, may be provided with a composite material construction with a greater resistance to tensile forces than a lower region of the fluid conduit. This may facilitate tailoring of the fluid conduit to the precise operational conditions, which may result in a reduction in material usage and thus costs.

The riser system may comprise one or more conduits, cables, fibres, umbilicals or the like for use in communication of electrical signals, optical signals, power and the like between the subsea location and vessel.

The composite fluid conduits may comprise the same or similar composite material and/or construction. Different composite fluid conduits may comprise different composite materials and/or construction.

At least one composite fluid conduit may extend as a single component along the length of the elongate support. Accordingly, the provision of a single component may eliminate the requirement for connectors along the length of the conduit.

According to a second aspect of the present invention there is provided a method of communicating fluid between a subsea location and a surface or near surface vessel, comprising:

securing a lower riser section between a lower subsea anchor and an upper buoyant structure, the lower riser section having an elongate support and a plurality of composite fluid conduits secured to and extending adjacent the elongate support, wherein the composite fluid conduits comprise a composite material formed of at least a matrix and one or more reinforcing elements embedded within the matrix; and securing an upper riser section between the lower riser section and a surface or near surface vessel, wherein the upper riser section comprises a plurality of flexible conduits in fluid communication with the composite fluid conduits.

The method according to the second aspect may utilise the hybrid riser system according to the first aspect. Features defined and implied in relation to the first aspect may be applied to the method according to the second aspect.

According to a third aspect of the present invention there is provided a hybrid riser system comprising:

a lower riser section having an elongate support and at least one composite fluid conduit secured to and extending adjacent the elongate support, wherein the composite fluid conduit comprises a composite material formed of at least a matrix and one or more reinforcing elements embedded within the matrix; and an upper riser section extending between the lower riser section and a surface or near surface vessel and comprising at least one flexible conduit in fluid communication with the at least one composite fluid conduit.

A further aspect may relate to a hybrid riser system, comprising:

a lower riser section secured between a lower subsea anchor and an upper buoyant structure and comprising an elongate support and one or more composite fluid conduits secured to and extending adjacent the elongate support, wherein the composite fluid conduits comprise a composite material formed of at least a matrix and one or more reinforcing elements embedded within the matrix, and wherein at least one composite fluid conduit is rigidly secured to the elongate support at at least one location to permit load transference between the conduit and the elongate support; and an upper riser section extending between the lower riser section and a surface or near surface vessel and comprising one or more flexible conduits in fluid communication with the composite fluid conduits.

Accordingly, the rigid connection between at least one conduit and the elongate support may prevent relative longitudinal movement of the conduit and support, at least at the region of connection.

Another aspect may relate to a method for communicating fluid between a subsea location and a surface or near surface vessel, comprising:

securing a lower riser section between a lower subsea anchor and an upper buoyant structure, the lower riser section having an elongate support and one or more composite fluid conduits secured to and extending adjacent the elongate support, wherein the composite fluid conduits comprise a composite material formed of at least a matrix and one or more reinforcing elements embedded within the matrix;

rigidly securing at least one composite fluid conduit to the elongate support at at least one location; and securing an upper riser section between the lower riser section and a surface or near surface vessel, wherein the upper riser section comprises one or more flexible conduits in fluid communication with the composite fluid conduits.

The method may comprise first securing the elongate support between the subsea anchor and the buoyant structure, and subsequently securing a composite fluid conduit to the elongate support. This may facilitate retrofitting the conduit to the elongate support.

Features defined in relation to one aspect may be provided in combination with any other aspect.

BRIEF DESCRIPTION OF DRAWINGS

These and other aspects of the present invention will now be described, by way of example only, with reference to the accompanying drawings, in which.

DETAILED DESCRIPTION OF THE DRAWINGS

Figure 1:
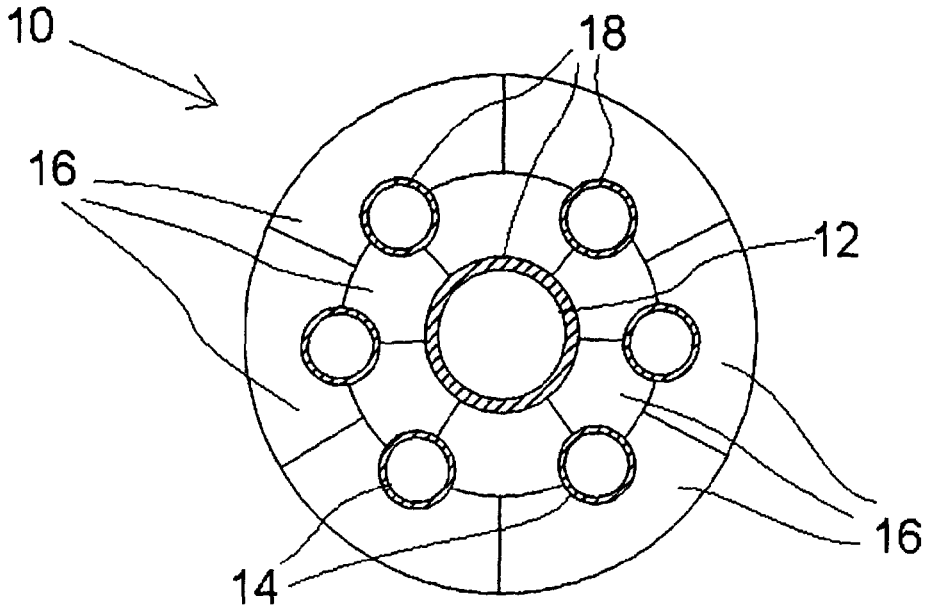
(PRIOR ART) FIG. 1
FIG. 1 is a lateral cross sectional view of a known hybrid riser section which includes syntactic foam modules.
Figure 2:
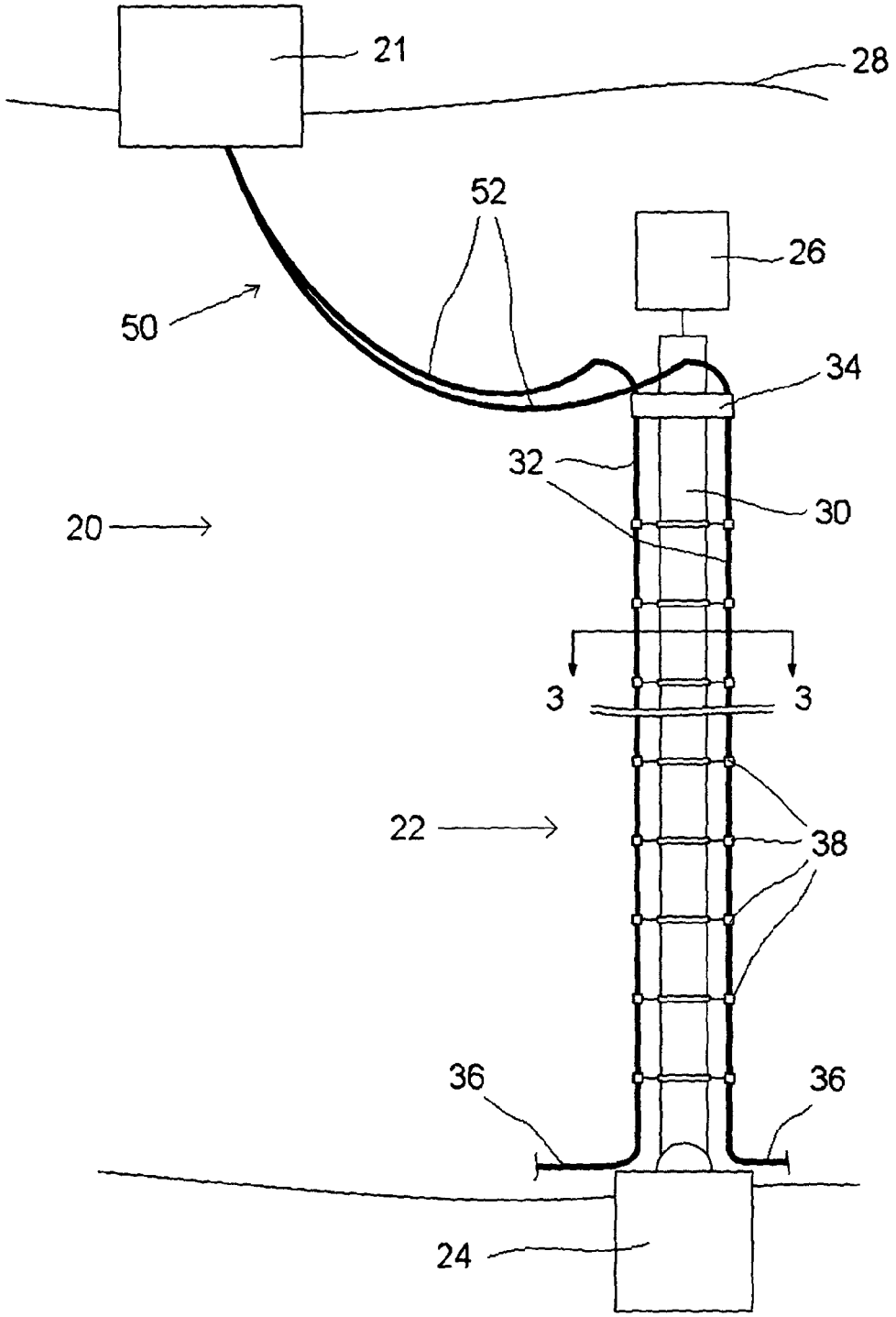
FIG. 2 is a diagrammatic illustration of a hybrid riser system according to an embodiment of the present invention.

A hybrid riser system, generally identified by reference numeral 20, in accordance with an embodiment of the present invention is illustrated in FIG. 2. As will be described in detail below, the riser system 20 is arranged to provide communication of fluids between a subsea location and a surface vessel 21, such as a FPSO vessel.

The system 10 comprises a lower riser section 22 which extends between a seabed anchor 24 and a buoyant structure in the form of an aircan 26. The aircan 26, which is positioned below the water surface 28 and thus isolated from surface conditions, provides an upward thrust to apply tension to the riser section 22 and to hold said section in a substantially vertical upright position.

The lower riser section 22 comprises a central elongate support 30 in the form of a pipe string which is evacuated and sealed. The lower end of this elongate support 30 is secured to the anchor 24, and the upper end is coupled to the aircan 26. Accordingly, the upward thrust from the aircan 26 is applied along the support 30.

A plurality of peripheral composite fluid conduits 32 (only two shown in FIG. 2 for clarity) extend adjacent the elongate support 30, wherein the conduits 32 are formed from a composite material of a matrix and a plurality of reinforcing elements embedded within the matrix. Although different variations of composite material are possible, in the present embodiment the matrix comprises polyether ether ketone (PEEK) with carbon fibre reinforcing elements embedded within the PEEK matrix.

The lower ends of the composite fluid conduits 32 are secured to respective feed conduits 36 which carry fluids, such as hydrocarbons, to be communicated via the riser system 20 to the surface vessel 21.

The composite construction of the fluid conduits 32 may permit said conduits to exhibit sufficiently high strength to accommodate pressure loading and other applied loadings. Furthermore, the composite construction may permit the composite fluid conduits 32 to be configured with near neutral buoyancy when the lines are air filled in-water. This may allow the need for complex and expensive additional buoyancy, such as syntactic buoyancy material, to be eliminated or at least minimised.

The composite construction of the fluid conduits 32 may permit significantly improved thermal characteristics in comparison to non-composite structures. For example, the composite construction may provide greatly reduced thermal conductivity which reduces heat loses and allows the need for insulation to be eliminated or greatly reduced. Furthermore, the composite construction may assist to minimise thermal expansion characteristics. For example, the composite construction of the fluid conduits may permit lower axial length variation compared to non-composite structures and thus assist to eliminate or at least alleviate associated problems. However, even in circumstances where axial length variation does occur, such variations can be accommodated by the composite construction by virtue of an increased ability to accommodate higher strain rates. Thus, for example, axial compression and tensile forces may be more readily accommodated. Furthermore, any lateral deformations caused by axial extension may also be readily accommodated without risk of exceeding operational yield limits.

The composite fluid conduits 32 are rigidly secured to the upper end of the elongate support 30 via a connection arrangement 34 such that the weight of the conduits 32 is transferred into the elongate support 30 and ultimately carried by the aircan 26. The composite construction of the conduits 32 permits the conduits to be lighter than non-composite structures and as such the aircan 26 and elongate support 30 are required to accommodate lower loads. In view of this, the volume of the aircan 26 can be reduced, perhaps by up to 50%, providing advantages in terms of handling, deployment and the like. Furthermore, the support 30 may also be downsized. Also, the provision of composite fluid conduits 32 may enable the hybrid riser system 20 to be utilised in greater water depths.

The lower riser section 22 also comprises a plurality of guide structures 38 which are arranged axially along the length of the elongate support 30 and function to retain the fluid conduits 32 in radial proximity to the support 30, while permitting axial movement of the fluid conduits 32 relative to the elongate support 30. Accordingly, the guide structures may be considered to permit the fluid conduits 32 to be compliantly coupled to the elongate support 30 at various locations along its length.

Figure 3:
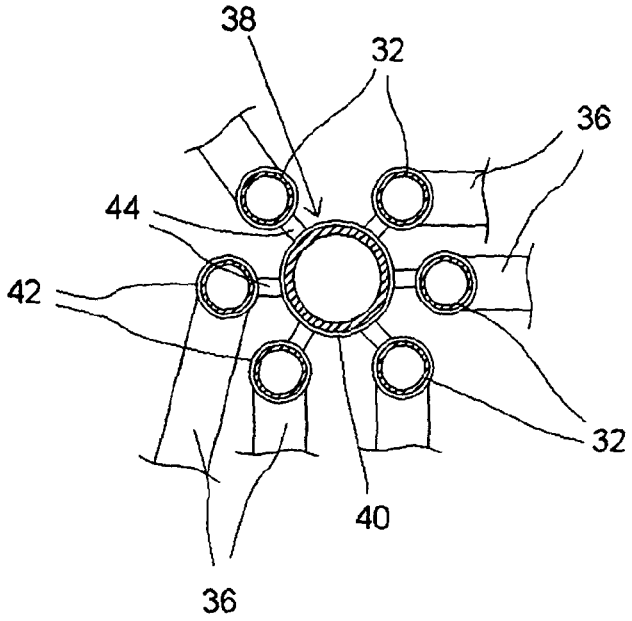
FIG. 3 is a lateral cross-section through line 3-3 of FIG. 2.

A detailed illustration of a guide structure 38 is shown in FIG. 3, which is a lateral cross section through line 3-3 in FIG. 2. Each guide structure 38 comprises a sleeve 40 which is secured around the elongate support 30. A plurality of tubular guide or funnel members 42 are secured to the sleeve 40 via respective radial arms 44. Each guide member 42 accommodates a fluid conduit 32 to extend therethrough, thus restricting relative lateral movement of the conduits 38 and support 30, while allowing the conduits 32 to move axially relative to the support 30. In an alternative embodiment the sleeve 40 may be eliminated and the radial arms 44 may be directly secured to the elongate support 30.

Referring again to FIG. 2, the riser system 20 further comprises an upper riser section 50 which extends between the lower riser section 22 and the surface vessel 21. The upper riser section 20 includes a plurality of flexible conduits 52 in fluid communication with respective composite fluid conduits 32 of the lower riser section 22. Accordingly, fluid from the feed lines 36 may be communicated to the surface vessel 21 via the composite fluid conduits 32 and the flexible conduits 52. In the present embodiment the flexible conduits 52 are free-hanging and extend in a catenary configuration between the vessel 21 and the lower riser section 20.

The flexible conduits 52 in the present embodiment are formed from a composite material of a matrix and a plurality of reinforcing fibres embedded within the matrix. The composite material of the flexible conduits 52 is the same as that which forms the fluid conduits 32. In the present embodiment the flexible conduits 52 are formed separately from the fluid conduits 32 and subsequently secured thereto, for example via stab-in type connectors or the like. However, in other embodiments the flexible conduits 52 may be integrally formed with the fluid conduits 32. That is, the flexible conduits 52 may be defined by extending the fluid conduits 32 from the lower riser section 22 to the vessel 21.

Figure 4:
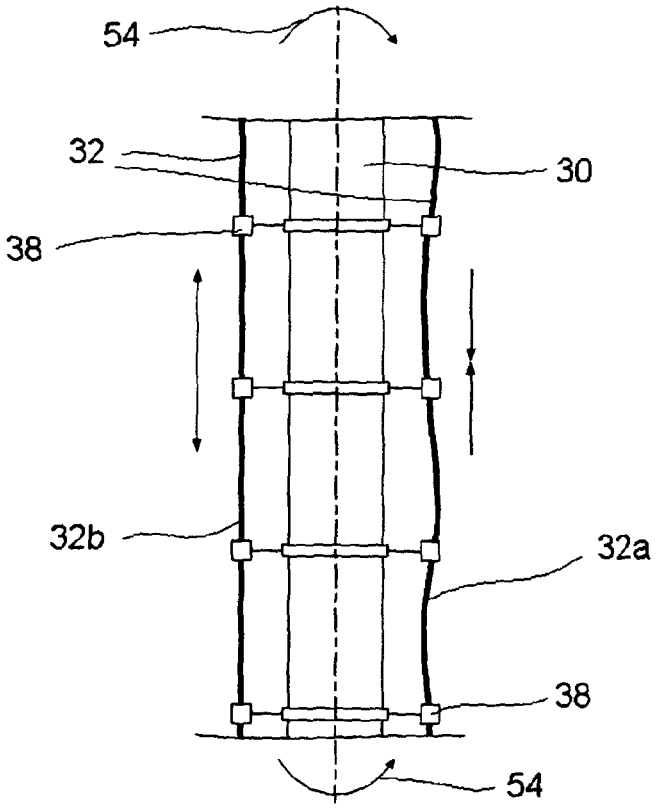
FIG. 4 is an enlarged view of a portion of the hybrid riser system of FIG. 2.

In the present embodiment the fluid conduits 32 of the lower riser section 22 are rigidly secured to the elongate support 30 only at the upper region. However, in other embodiments more than one rigid connection may be provided. In one particular embodiment a rigid connection may be provided at both the upper and lower regions of the elongate support 30. In such an arrangement any changes in axial length of the fluid conduit, for example by thermal and pressure effects, may result in axial compressive and/or tensile forces, and/or forces resulting from lateral deformation. Furthermore, any longitudinal bending of the elongate support, for example due to environmental conditions, may result in axially applied forces. For example, a fluid conduit on an inner side of a bend radius of the elongate structure will be subject to compressive forces, and perhaps also forces caused by any resulting lateral deformation. Conversely, a fluid conduit on an outer side of a bend radius of the elongate support will be subject to tensile forces. Such possible deformations of the fluid conduits 32 is illustrated in FIG. 4. In this respect, conduit 32*a* may represent the behaviour of a conduit subject to thermal expansion, and/or subject to axial compression due to bending of the elongate support 30, as illustrated by arrows 54. Furthermore, conduit 32*b* may represent the behaviour of a conduit subject to thermal contraction, and/or subject to axial tension due to bending of the support 30. The composite construction of the fluid conduits 32 permits increased strain rates to be accommodated thus permitting such deformations and associated loading to be readily accommodated within yield limits.

Figure 5:
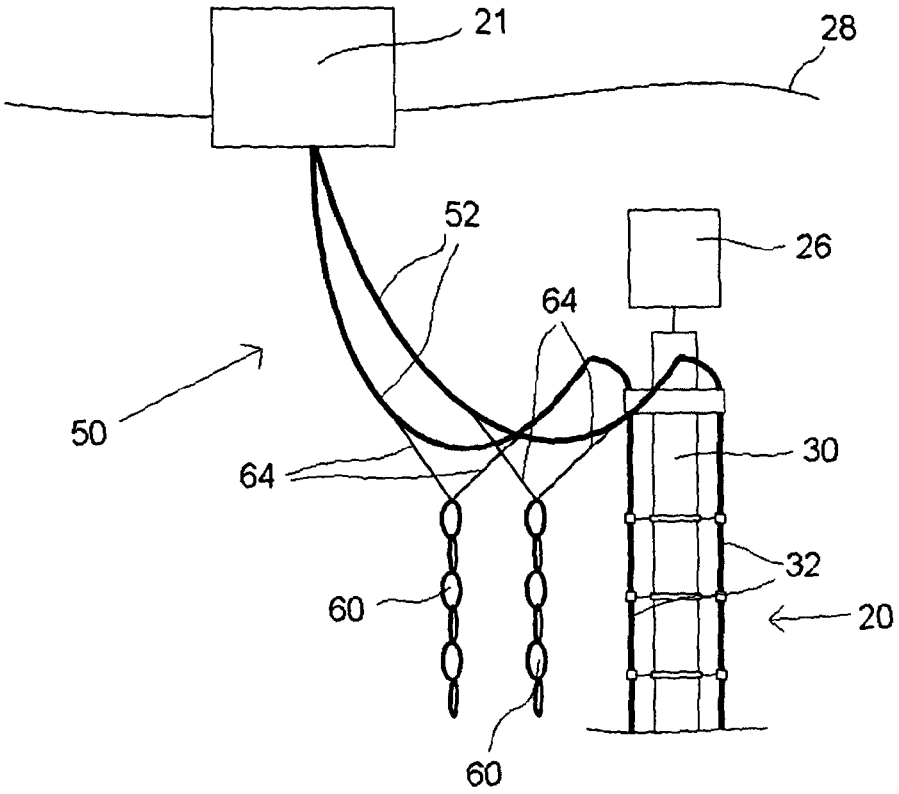
FIG. 5 is a diagrammatic illustration of a portion of a hybrid riser system in accordance with an alternative embodiment of the present invention.

In the embodiment described above the flexible conduits 52 of the upper riser section 50 are formed of a composite material. While the reduced weight of such a composite material is advantageous, in some situations this may present certain problems. For example, the dynamic response of light-weight flexible conduits 52 may be undesirable, such as having poor resistance to deviation caused by vessel motion or environmental conditions, vibrational responses and the like. A modified embodiment of the present invention which recognises and seeks to address such problems is illustrated in FIG. 5, reference to which is now made. In this case the embodiment of FIG. 5 is almost identical to that first shown in FIG. 2 and as such like components share like reference numerals. Further, for the purposes of brevity only the differences will be highlighted.

Specifically, in the embodiment shown in FIG. 5 the flexible conduits 52 of the upper riser section are provided with respective weight arrangements 60 which are hung from the conduits 52 generally in the lowermost hanging regions of said conduits. In the present embodiment the weight arrangements 60 each comprise a length of chain 62 which is secured to a respective conduit 52 via a bridle system 64. Each weight arrangement 60 functions to apply tension within a respective conduit 52 between the vessel 21 and the point of connection of the weight arrangement 60, and also between this point of connection and the lower riser section 20. This application of tension within the normally lightweight conduits 52 improves the dynamic response of these conduits 52.

It should be understood that the embodiments described herein are merely exemplary and that various modifications may be made thereto without departing from the scope of the invention. Fort example, any suitable number of conduits may be provided in the upper and lower riser sections. Also, additional conduits, control lines, umbilicals or the like may be provided which may, for example, provide signal communication, power transfer or the like. Also, the present invention may be suitably utilised to permit flow from the surface vessel to the seabed.

The invention claimed is:

1. A hybrid riser system, comprising:

a lower riser section secured between a lower subsea anchor and an upper buoyant structure and comprising an elongate support and one or more composite fluid conduits secured to and extending adjacent the elongate support, wherein the one or more composite fluid conduits comprise a composite material formed of at least a matrix and one or more reinforcing elements embedded within the matrix, and wherein at least one of the one or more composite fluid conduits is rigidly secured to the elongate support at one or more locations between the lower subsea anchor and the upper buoyant structure to permit load transference between the at least one of the one or more composite fluid conduits and the elongate support; and an upper riser section extending between the lower riser section and a surface or near surface vessel and comprising one or more flexible conduits in fluid communication with the one or more composite fluid conduits.

2. The system according to claim 1, wherein the elongate support is configured to support the weight of the one or more composite fluid conduits.

3. The system according to claim 1, wherein at least one of the one or more composite fluid conduits is rigidly secured to an upper region of the elongate support.

4. The system according to claim 1, wherein at least one of the one or more composite fluid conduits is rigidly secured to a lower region of the elongate support.

5. The system according to claim 1, wherein at least one of the one or more composite fluid conduits is rigidly secured to both upper and lower regions of the elongate support.

6. The system according to claim 1, wherein the composite construction provides the one or more composite fluid conduits with near neutral buoyancy when the one or more composite fluid conduits are air filled in-water.

7. The system according to claim 1, wherein the lower riser section is arranged in a substantially linear configuration.

8. The system according to claim 1, wherein the lower riser section is arranged in a substantially vertical orientation.

9. The system according to claim 1, wherein the elongate support is secured between the lower anchor and the upper buoyant structure, and upward thrust applied by the buoyant structure establishes tension within the elongate support.

10. The system according claim 1, wherein at least one of the one or more composite fluid conduits are formed exclusively from the composite material.

11. The system according claim 1, wherein the entire wall thickness of at least one of the one or more composite fluid conduits is formed of the composite material.

12. The system according to claim 1, wherein the quantity of reinforcing elements varies through the wall thickness of at least one of the one or more composite fluid conduits, from zero at the inner region of the wall of at least one of the one or more composite fluid conduits, and increases in quantity in an outwardly radial direction.

13. The system according to claim 1, wherein at least one of the one or more flexible conduits extends between the vessel and the lower riser section in a catenary form.

14. The system according to claim 1, wherein the one or more flexible conduits are integrally formed with corresponding ones of the one or more composite fluid conduits.

15. The system according to claim 1, wherein at least one of the one or more composite fluid conduits is compliantly secured to the elongate support at one or more locations.

16. The system according to claim 15, wherein the compliant connection is achieved in at least one of an axial and lateral direction.

17. The system according to claim 15, wherein the compliant connection permits relative axial movement of the at least one of the one or more composite fluid conduits and the elongate support and restricts relative lateral movement between the at least one of the one or more composite fluid conduits and the elongate support at the point of connection.

18. The system according to claim 15, wherein the at least one of the one or more composite fluid conduits is compliantly secured to the elongate support at a location which is intermediate opposing end regions of the elongate support.

19. The system according to claim 15, wherein the at least one of the one or more composite fluid conduits is compliantly secured to the elongate support at multiple locations.

20. The system according to claim 15, wherein the compliant connection is provided by a guide structure which comprises one or more tubular guide portions for accommodating passage of the at least one of the one or more composite fluid conduits therethrough.

21. The system according to claim 1, wherein at least one of the one or more flexible conduits comprises a composite material formed of at least a matrix and one or more reinforcing elements embedded within the matrix.

22. The system according to claim 1, comprising a weight arrangement secured to at least one of the one or more flexible conduits of the upper riser section.

23. The system according to claim 22, wherein the weight arrangement modifies the dynamic response of the at least one of the one or more flexible conduits of the upper riser section.

24. The system according to claim 22, wherein the weight arrangement biases the at least one of the one or more flexible conduits into a desired shape or form.

25. The system according to claim 22, wherein the weight arrangement is secured to a region of the at least one of the one or more flexible conduits which is intended to define a lowermost region of the at least one of the one or more flexible conduits.

26. The system according to claim 22, wherein a single weight arrangement is provided.

27. The system according to claim 26, wherein the single weight arrangement is secured to the at least one of the one or more flexible conduits.

28. The system according to claim 22, wherein a plurality of weight arrangements are provided and secured to different flexible conduits of the at least one of the one or more flexible conduits or different groups of the at least one of the one or more flexible conduits.

29. The system according to claim 22, wherein the weight arrangement applies axial tension within the at least one of the one or more flexible conduits between the vessel and the point of connection of the weight arrangement to the at least one of the one or more flexible conduits.

30. The system according to claim 22, wherein the weight arrangement applies axial tension within the at least one of the one or more flexible conduits between the lower riser section and the point of connection of the weight arrangement to the at least one of the one or more flexible conduits.

31. The system according to claim 22, wherein the weight arrangement comprises one or more chain links.

32. The system according to claim 1, wherein the composite material of a wall of at least one of the one or more composite fluid conduits comprises or defines a local variation in construction to provide a local variation in a property of the at least one of the one or more composite fluid conduits.

33. The system according to claim 32, wherein at least one location of at least one of the one or more fluid conduits which is configured to interact with another structure defines a local region of increased strength.

34. The system according to claim 1, wherein at least one of the one or more composite fluid conduits extends as a single component along the length of the elongate support.

35. A method for communicating fluid between a subsea location and a surface or near surface vessel, comprising:

securing a lower riser section between a lower subsea anchor and an upper buoyant structure, the lower riser section having an elongate support and one or more composite fluid conduits secured to and extending adjacent the elongate support, wherein the one or more composite fluid conduits comprise a composite material formed of at least a matrix and one or more reinforcing elements embedded within the matrix;

rigidly securing at least one of the one or more composite fluid conduits to the elongate support at one or more locations between the lower subsea anchor and the upper buoyant structure; and securing an upper riser section between the lower riser section and the surface or near surface vessel, wherein the upper riser section comprises one or more flexible conduits in fluid communication with the one or more composite fluid conduits.

36. The method according to claim 35, comprising first securing the elongate support between the subsea anchor and the buoyant structure, and subsequently securing at least one of the one or more composite fluid conduits to the elongate support.

* * * * *